US005160199A

United States Patent [19]

Berti

[11] Patent Number: 5,160,199

[45] Date of Patent: Nov. 3, 1992

[54] HALOGEN LAMP REFLECTOR INCLUDING A CERAMIC MATERIAL PARABOLOID LIGHT REFLECTING ELEMENT

[76] Inventor: Franco Berti, via Isonzo, 9, 20090 Buccinasco, Milan, Italy

[21] Appl. No.: 621,269

[22] Filed: Dec. 3, 1990

[30] Foreign Application Priority Data

Dec. 6, 1989 [IT] Italy ..... 22610 A/89

[51] Int. Cl.[5] ..... F21V 7/22

[52] U.S. Cl. ..... 362/346; 362/347; 362/350; 313/113

[58] Field of Search ..... 362/346, 347, 350, 263, 362/296; 313/113

[56] References Cited

U.S. PATENT DOCUMENTS

| | | | |
|---|---|---|---|
| 1,008,902 | 11/1911 | Haehnel | 362/350 |
| 1,413,315 | 4/1922 | Correll | 362/350 |
| 3,443,086 | 5/1969 | Rikis | 362/346 |
| 4,021,659 | 5/1977 | Wiley | 362/297 |
| 4,254,455 | 3/1981 | Neal, Jr. | 362/347 |
| 4,347,554 | 8/1982 | Matsushita | 362/346 |
| 4,545,000 | 10/1985 | Fraley et al. | 362/346 |
| 4,645,290 | 2/1987 | Walsh | 313/113 |
| 4,670,825 | 6/1987 | Fouke | 362/346 |
| 4,728,848 | 3/1988 | Walsh | 313/113 |
| 4,755,711 | 7/1988 | Fields et al. | 362/215 |
| 4,833,576 | 5/1989 | Mers et al. | 362/263 |
| 4,855,886 | 8/1989 | Eijkelenboom et al. | 362/350 |
| 4,866,329 | 9/1989 | Ferenc | 313/113 |

FOREIGN PATENT DOCUMENTS

| | | | |
|---|---|---|---|
| 3269103 | 11/1988 | Japan | 362/346 |
| 16225 | 7/1912 | United Kingdom | 362/350 |

*Primary Examiner*—Ira S. Lazarus
*Assistant Examiner*—Y. Quach
*Attorney, Agent, or Firm*—Bucknam and Archer

[57] ABSTRACT

A halogen lamp reflector assembly includes a ceramic material paraboloid light reflecting element having an inner surface which is coated by gold oxides so as to provide the inner surface with very high light reflecting properties, coaxially arranged with respect to the paraboloid element there being restrained a socket element for receiving the halogen lamp of the assembly.

1 Claim, 1 Drawing Sheet

HALOGEN LAMP REFLECTOR INCLUDING A CERAMIC MATERIAL PARABOLOID LIGHT REFLECTING ELEMENT

BACKGROUND OF THE INVENTION

The present invention relates to a halogen lamp reflector including a ceramic material paraboloid light reflecting element.

As is known there are at present made illuminating bodies or light reflectors which, while having a comparatively reduced size, are designed to provide high intensity light beams.

This light reflectors usually comprise a small lamp the lamp body of which is filled with a halogen gas, the lamp being housed in a paraboloid lamp holder body having a substantially mirror-like surface.

The mentioned paraboloid lamp holder body, which substantially provides a full reflecting concave surface, is conventionally made of a glass material including a borosilicate additive.

The method for making these reflectors, on the other hand, is rather complex and scarcely reliable, and, moreover, provides products of a poor finishing.

Moreover, the thus made glass paraboloid element has a poor resistance against impacts and temperature variations as caused by the great amount of heat generated by the halogen lamps.

SUMMARY OF THE INVENTION

Accordingly, the main object of the present invention is to overcome the above mentioned drawbacks by providing a halogen lamp reflector which is very simple construction wise.

Another object of the present invention is to provide such a halogen lamp reflector which has a great resistance against impacts and temperature variations.

Yet another object of the present invention is to provide such a halogen lamp reflector which includes a paraboloid element so designed as to be easily coated by suitable light reflecting materials.

According to one aspect of the present invention, the above mentioned objects, as well as yet other objects, which will become more apparent hereinafter, are achieved by a halogen lamp reflector characterized in that said reflector substantially includes a ceramic material paraboloid element coated by suitable metal oxides adapted to provide a mirror-like inner surface of said paraboloid element, a two pin socket being moreover provided coaxially restrained or secured to said paraboloid element by means of a cementing substance.

BRIEF DESCRIPTION OF THE DRAWING

Further characteristics and advantages of the halogen lamp projector according to the present invention will become more apparent from the following detailed description of a preferred, though not exclusive, embodiment thereof, which is illustrated, by way of an indicative but not limitative example, in the figures of the accompanying drawing where.

DESCRIPTION OF THE PREFERRED EMBODIMENT

Figure 1:
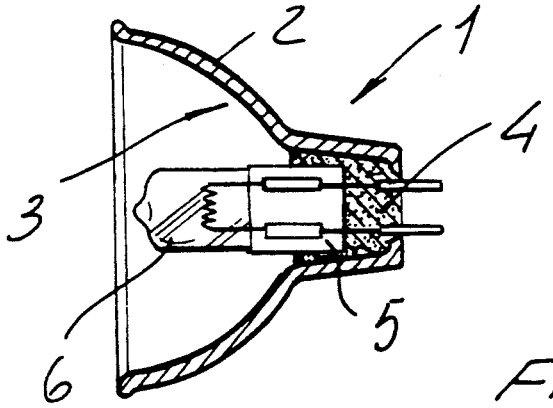
FIG. 1 is a longitudinal cross-sectional view of the halogen lamp projector according to the present invention.
Figure 2:
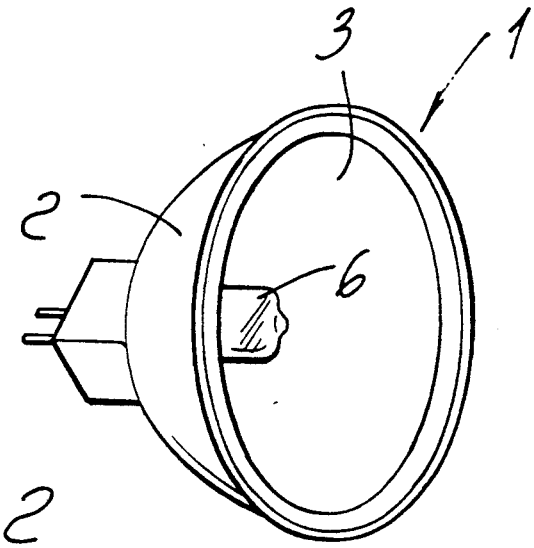
FIGS. 2 and 3 are respectively perspective views showing two possible embodiments of the paraboloid element associated with the subject halogen lamp projector.
Figure 3:
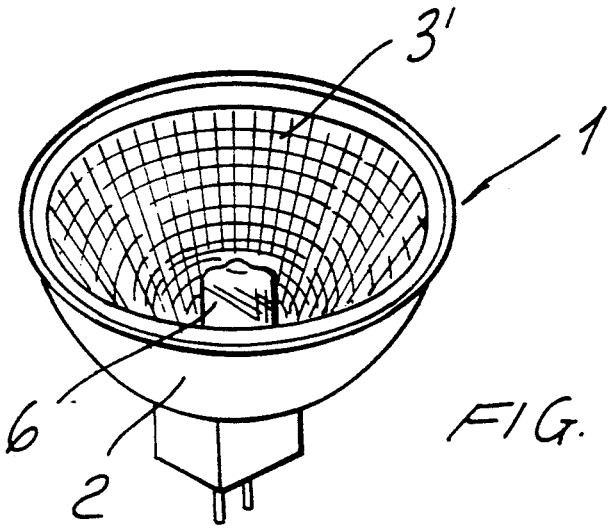

With reference to the figures of the accompanying drawing, the halogen lamp projector according to the invention, which is generally indicated as the reference number 1, includes a substantially paraboloid element 2 having a circular or polygonal cross-section shape.

This paraboloid element, in particular, is made starting from any suitable ceramic materials and has a smooth 3 or faceted 3′ inner surface, depending on the contingent use requirements.

The inner surface of said paraboloid element, moreover, is coated, by means of a metalizing process, by platinum, or silver or gold oxides.

Coaxially arranged with respect to the paraboloid element there is restrained, by any suitable cementing substance 4, a two pin socket 5 for receiving a halogen lamp 6.

In this connection it should be apparent that the disclosed ceramic material paraboloid element allows the light reflecting material to be applied in a very quick and simple way.

From the above disclosure it should be pointed out that the invention fully achieves the intended objects.

While the invention has been disclosed and illustrated with reference to a preferred embodiment thereof, it should be apparent that the disclosed embodiment is susceptible to several modifications and variations all of which will come within the spirit and scope of the appended claims.

I claim:

1. A halogen lamp projector, comprising a reflector of ceramic material which is:

paraboloid in shape having a mirror-like inner surface coated with gold oxides through a metalizing process, and a two-pin socket coaxially secured to said paraboloid reflector by means of a cementing substance, said two-pin socket provides on electrical connection for a halogen lamp.

* * * * *